US010053833B2

(12) United States Patent
Baumgartner et al.

(10) Patent No.: US 10,053,833 B2
(45) Date of Patent: Aug. 21, 2018

(54) PRE-CAST DECORATIVE RETAINING WALL SYSTEM

(71) Applicant: ECO CONCRETE SOLUTIONS, INC., Brighton, CO (US)

(72) Inventors: Russel W. Baumgartner, Rancho Santa Fe, CA (US); Richard K. Taylor, San Diego, CA (US); Lizzy N. Baumgartner, Rancho Santa Fe, CA (US)

(73) Assignee: ECO CONCRETE SOLUTIONS, INC., Brighton, CO (US)

( * ) Notice: Subject to any disclaimer, the term of this patent is extended or adjusted under 35 U.S.C. 154(b) by 148 days.

(21) Appl. No.: 14/604,583

(22) Filed: Jan. 23, 2015

(65) Prior Publication Data

US 2015/0211204 A1 Jul. 30, 2015

Related U.S. Application Data

(60) Provisional application No. 61/931,044, filed on Jan. 24, 2014.

(51) Int. Cl.
*E02D 29/02* (2006.01)

(52) U.S. Cl.
CPC ..... *E02D 29/0283* (2013.01); *E02D 29/02* (2013.01); *E02D 29/0266* (2013.01); *E02D 29/0275* (2013.01)

(58) Field of Classification Search
CPC . E02D 29/02; E02D 29/0283; E02D 29/0266; E02D 29/0275
See application file for complete search history.

(56) References Cited

U.S. PATENT DOCUMENTS 3,195,312 A * 7/1965 Rumsey, Jr. ..... E02D 29/0266 405/287
4,000,622 A * 1/1977 Chiaves ..... E02D 29/0266 405/286
4,290,246 A * 9/1981 Hilsey ..... E02D 27/02 52/125.3
4,569,173 A * 2/1986 Hultquist ..... E02D 27/01 52/293.1

(Continued)

FOREIGN PATENT DOCUMENTS

JP 05125740 A * 5/1993

*Primary Examiner* — Benjamin F Fiorello
(74) *Attorney, Agent, or Firm* — Richard D. Clarke

(57) ABSTRACT

The present invention is directed to a Pre-cast Decorative Retaining Wall consisting of concrete walls constructed on a horizontal surface normally at a manufacturing facility, on rolling platforms, or preferably built on the construction site where after curing to 3000 psi the pre-fabricated walls can be shipped to and installed at a building site. In the flat state the panels can have a wide variety of decorative elements readily applied to both the upper and lower downside reflection surface. A unique feature is the buttress system that is added to the back of the wall system when elevated retention is required. By pouring the buttress portion on top of the footing pier or caisson, and tying into the pre-decorated wall with reinforcement, an eco-friendly, design optional retaining wall system is accomplished which can be rapidly and safely installed.

19 Claims, 14 Drawing Sheets

(56) References Cited

U.S. PATENT DOCUMENTS 4,911,585 A * 3/1990 Vidal ..... E02D 29/0283 405/284
4,993,872 A * 2/1991 Lockwood ..... E01F 5/005 405/125
5,125,765 A * 6/1992 Verble ..... A01K 61/00 405/284
5,131,786 A * 7/1992 House ..... B65D 88/76 404/6
5,308,195 A * 5/1994 Hotek ..... E02D 29/0283 405/284
5,471,811 A * 12/1995 House ..... E01F 8/0011 256/13.1
5,492,438 A * 2/1996 Hilfiker ..... E02D 29/0241 405/285
5,536,113 A * 7/1996 McGregor ..... E02D 29/045 405/125
5,624,615 A * 4/1997 Sandorff ..... B28B 7/0088 264/247
6,243,994 B1 * 6/2001 Bernini ..... E02D 29/045 14/26
6,367,214 B1 * 4/2002 Monachino ..... E02D 27/02 52/247
7,614,830 B1 * 11/2009 Ritke ..... E02D 29/02 404/6
8,425,152 B1 * 4/2013 South ..... E02D 29/05 405/124
8,425,153 B1 * 4/2013 South ..... E02D 29/00 405/124
8,568,057 B2 * 10/2013 Rodriguez ..... E01F 15/083 256/13.1
2003/0143029 A1 * 7/2003 Lockwood ..... E01F 5/005 405/125
2009/0232608 A1 * 9/2009 Chouery ..... E02D 29/02 405/287
2011/0211918 A1 * 9/2011 Johnson ..... E04C 1/395 405/286
2014/0270990 A1 * 9/2014 Heraty ..... E02D 29/0266 405/286

* cited by examiner

PRE-CAST DECORATIVE RETAINING WALL SYSTEM

FIELD OF THE INVENTION

The present invention provides a process for constructing concrete retaining walls. More particularly, the present invention provides a process for constructing concrete retaining walls at a remote location using pre-fabricated wall panels with a unique variety of design and decoration capabilities the customer can create, and then have transported to the building site, or be pre-fabricated on the building site, to be installed as a retaining wall using a specially designed footing and buttress support system if required, or as a monument wall or fence.

BACKGROUND OF THE INVENTION

Pre-cast tilt-up, cast on site or off site, (also known as Pre-cast tilt-slab or tilt-wall) concrete construction is not new and has been in use since the turn of the century. Since the mid-1940s it has developed into the preferred method of construction for many types of buildings and structures in the U.S. Pre-cast concrete construction has many advantages that are well known in the art. The Pre-cast concrete panels can significantly reduce the initial cost of construction and provide a relatively low-cost low-maintenance structure. Depending on the size and type of application, such Pre-cast panels can be fabricated and stored offsite then delivered just in time for installation. They can also be constructed by prefabricating the walls on the construction site thereby eliminating relatively expensive transportation costs (pre-fabrication on site).

After concrete footings and a concrete slab or any level base have been poured and properly cured, or a level casting bed (or any other level substrate) has been constructed, as Pre-cast tilt-up concrete structural panels can be formed on the concrete slab. In tilt-up concrete construction, vertical concrete elements, such as walls, columns, structural supports, and the like, are formed horizontally on a concrete slab; usually the building floor, but sometimes on a temporary concrete casting. After the concrete has cured, the elements are tilted from horizontal to vertical with a crane and braced into position until the remaining building structural components are secured. In the same way, the Pre-cast concrete panels can be formed in an offsite location, or on site location, using various types of forms well known in the art. After curing the Pre-cast and cured panels are transported to the building site and installed by means and methods well known in the art.

Construction of a Pre-cast concrete wall panel is begun by carefully planning out the size and shape of the wall panel on a suitable surface, such as the concrete slab, or any other level substrate (i.e., floor) of the building being constructed. A form release agent and bond breaker is then applied to the concrete slab and to panel forms in accordance with manufacturer recommendations.

After the form is constructed, a grid of steel rebar is constructed and tied in-place within the form to reinforce the structural panel. Plastic or metal support chairs are used to support the rebar grid, at a proper depth. Inserts provide attachment points for lifting hardware and temporary braces.

Before concrete is placed in the form, the slab or casting surface must be cleaned and a release bond breaking agent is applied to prevent the panel from bonding to the casting surface. Regardless of the type of bond breaking agent used, there is always a certain amount of bond formed between the Pre-cast panel and the casting surface that must be broken before the panels will separate, from the casting surface. Additional steel reinforcement is factored in so that the concrete panels can be lifted in place without damage. Concrete is then placed in the form in the same manner as floor slabs. The concrete is usually consolidated to ensure good flow around the steel rebar grid. Then, the concrete surface can be finished in any desired manner, such as trowel finish or other types of architectural finishes and patterns. On optional level substrates, the down side reflective surface can also be made decorative with types of artistic finishes and patterns.

Numerous innovations for the wall systems have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Pre-cast Decorative Retaining Wall System and the prior art.

U.S. Pat. No. 4,031,684 of Tokaito Shibata describes a decorative Pre-cast concrete boards having a pore-free decorative porcelain-tile-like, hewn-stone-like or relief surface and a porous core layer are provided. Such Pre-cast concrete boards are produced by applying inorganic cement mortar containing siliceous volcanic sand called "shirasu" in a flat mold made of an elastomeric material so as to form the pore-free surface and pouring thereon an inorganic concrete mortar containing expanded particles of said siliceous sand as the aggregate. The concrete boards do not suffer efflorescence.

This patent describes decorative Pre-cast concrete boards having a pore-free decorative porcelain-tile-like, hewn-stone-like or relief surface and a porous core layer. Although this patent does describe decorative features it does not describe the unique back lighted tesserae components or the unique buttress support feature for constructing higher retaining walls.

U.S. Pat. No. 5,624,615 of Daniel R. Saritiorff describes a modular stone panels which simulate assembled masonry, and are useful for decorative walls, retaining walls, facings for structures and the like. Pre-cast stone-faced panels are made by setting stones such as field stone having at least one relatively flat face, substantially directly on the bottom of a rectangular mold. The stones are set in the mold individually while packing sand around and between the stones but not under them. This is done by sliding each stone laterally across the bottom of the mold, thereby packing the sand while substantially keeping the stones supported immovably against the bottom. The stones do not float on a sand bed and the sand between them is packed. Thus the stone and sand are less readily displaced by concrete poured over them during vibration, causing a liquid portion of the concrete to diffuse into the sand. Retaining rods are carried on coil threaded rods that are removed to provide either points of attachment for mounting or lifting, or as weep holes. The retaining rods can extend into edge cavities and preferably into tubular receptacles, filled with concrete to lock joints between adjacent panels. For making corners, alternating stones protrude from the concrete in a first cast panel, and are interleaved with stones when casting a next panel so as to extend around the corner in lieu of a solid concrete strip. The stone facing can extend over only a part of the panel height, particularly for retaining walls, which can be passively braced using the threaded point of attachment and a buried anchor such as an automobile tire.

This patent describes decorative walls, retaining walls, facings for structures and the like done by sliding each stone laterally across the bottom of the mold, thereby packing the sand while substantially keeping the stones supported immovably against the bottom. This patent does not describe the unique back lighted tesserae components or the buttress support feature. It also does not describe the use of the decorative walls in a smaller scale to be used as monument walls of quickly assembled fencing material.

U.S. Pat. No. 8,555,584 of Romeo Harkin Ciuperca describes a method of forming a concrete structure. The method comprises placing plastic concrete in a form of a desired shape, encasing the concrete in insulating material having insulating properties equivalent to at least 1 inch of expanded polystyrene and allowing the plastic concrete to at least partially cure inside the insulating material. An insulated concrete form and a method of using the insulated concrete form are also disclosed.

This patent describes a method that comprises placing plastic concrete in a form of a desired shape, encasing the concrete in insulating material. This patent does not describe the buttress support features of this application along with the elevated decorative features, it also does not describe the use of the decorative walls in a smaller scale to be used as monument walls or quickly assembled fencing material.

U.S. Pat. No. 6,808,667 of Peter Anthony Nasdvik et al. describes a contoured wall and method is disclosed for creating the contour and appearance of a wall formed from individual assembled units such as stones. The wall is formed from a plurality of mating form liners each having a reciprocal contoured surface to that of the desired stone wall. The wall is formed from hardenable construction material such as concrete poured between two mold members with the form liners attached to at least one of the mold members. Each of the form liners has a lateral relief mold face adapted to provide a molded surface having the contour of a stone wall. Each lateral relief mold face of the form liners has a latticework non-linear mortar-forming interlocking portion surrounding stone-forming recessed portions. The form liners are positionable in a plurality of arrangements wherein the interlocking portions and recessed portions along the mating edge of each form liner mate along mating edge of the adjacent form liner to form a continuous lateral relief mold face.

This patent describes a contoured wall and method for creating the contour and appearance of a wall formed from individual assembled units such as stones. Although this patent does describe decorative features it does not describe the wide variety of features including the unique back lighted tesserae components or the unique buttress support feature.

None of these previous efforts, however, provides the benefits attendant with the Pre-cast Decorative Retaining Wall System. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the Pre-cast Decorative Retaining Wall System in detail it is to be understood that the design is not limited in its application to the details of construction and to the arrangement, of the components set forth in the following description or illustrated in the drawings. The Pre-cast Decorative Retaining Wall System is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Pre-cast Decorative Retaining Wall is that it can be manufactured at a factory and transported to a building site, or be prefabricated or manufactured on the final installation or building site.

Another advantage of the Pre-cast Decorative Retaining Wall is that numerous unique buttress support systems may to be used for installing elevated retaining walls.

Another advantage of the Pre-cast Decorative Retaining Wall is the way that the rebar in the wall is connected to the rebar in the buttress support system to elevate the bending moment of the wall.

Another advantage of the Pre-cast Decorative Wall is that it can incorporate tesserae or other transparent imbedded materials that can be back lit by various lighting, means including fiber optics prior to delivery.

Another advantage of the Pre-cast Decorative Retaining Wall is that it can incorporate a variety of through wall water features before delivery.

Another advantage of the like-cast Decorative Retaining Wall is it can be capped with electrical outlets and various electrical lighting features, gas or propane torches or attachments for Christmas decorations prior to delivery.

Another advantage of the Pre-cast Decorative Retaining Wall is a customer has the capability of choosing from a wide variety of decorative computer generated design features.

Another advantage of the Pre-cast Decorative Retaining Wall is a customer has the capability of directing and creating their own design features prior to delivery, or while the wall patterns are prefabricated on site.

Another advantage of the Pre-cast Decorative Retaining Wall is the design features can be projected down during the manufacturing process by the means of an overhead projector to create the exact repeating patterns on both surfaces if desired.

Another advantage of the Pre-cast Decorative Retaining Wall is Styrofoam inserts can be inset into the form to create decorative openings through the wall.

Yet another advantage of the Pre-cast Decorative Retaining Wall in a smaller scale can be used as memorial walls and many types of decorative fencing.

And another advantage of the Pre-cast Decorative Retaining Wall is that it is an eco-friendly system in that the walls are constructed horizontally and the formwork lumber is limited to the thickness of the wall, unlike cast in place where substantially more lumber, in the form of 2×4's and plywood, is required.

Yet another advantage of the Pre-cast Decorative Retaining Wall System is the variety of design options since the walls are constructed horizontally they can be decorated using techniques that are reserved only for flatwork, and since the walls are cast on a surface, the concrete will pick up the reflection of that surface and make unique impressions onto the wall that will be seen when the wall is erected vertically.

And another advantage of the Pre-cast Decorative Retaining Wall System is increased safety at the construction site in that since the wall is constructed horizontally it makes the use of scaffolding unnecessary, which eliminates having to work off the ground, making then safer to build (additionally high pressures within the framework is eliminated).

And another advantage of the Pre-cast Decorative Retaining Wall System is speed, since the walls are built, independent of the footings (unlike a masonry wall) the walls can be built before the footing is complete, the completed and cured walls can be stood on the footings within hours, and the buttress is poured immediately after and upon reaching 2500 psi, so within 24-48 hours it can be backfilled.

These together with other advantages of the Pre-cast Decorative Retaining Wall along with the various features of novelty, which characterize the design, are pointed out with particularity in the following summary of this application.

The Pre-cast Decorative Retaining Wall consists of concrete walls constructed on a horizontal surface normally at a manufacturing facility, preferably on rolling platforms, or at the building site (on soil). At the building site, footing preparation is made by compaction of the soil and forming the footing with the size and rebar reinforcing required by the height and dimensions of the wall. After the concrete has been placed for the footings and the prescribed period of time has passed the walls can be erected.

For retaining walls a unique buttress support system has been designed where rebar extending from the back of the wall is attached, via the concrete buttress, to rebar reinforcing that is left exposed from the footing on the back side of the wall where the buttress support system will be poured after the wall has been erected. The height of this attachment changes the moment arm about which the wall rotates from the bottom of the wall to the elevation of the attachment points. This attachment to the wall can be made by various methods, one being the rebar extending out of the back of the wall and bent parallel to the wall surface during construction. An additional method will be having commercially available anchoring systems such as the Richmond dowels or other rebar type coupling devices) to anchor the rebar in the wall to the rebar in the buttress support section of concrete. By elevating the attachment points and the size of the buttress support system the wall height may be extended safely.

For the basic undecorated wall system the wall forms will be setup over a release agent on rolling, platforms, or cast on the appropriate reflection medium. Miscellaneous hardware, lift inserts, weld plates and reinforcing rebar will be inserted within the forms.

A proprietary mixture of concrete (in some cases waterproofed) will be poured into the forms and vibrated to settle in if necessary. The surface will be screed and trowel finished with an applicable retarder if required. After a minimum 3000 psi is attained, the panels are generally available to be transported to the construction site where they can be power washed and have the densifying sealer applied to all the exposed surfaces, if necessary.

The decorative panel preparation consists of concrete walls constructed on a horizontal surface normally at a manufacturing facility, preferably on rolling platforms, or on site. The surface of the platform will either have a layer of emulsified sand, a form liner or Styrofoam beneath the forms before they are put in place. Miscellaneous hardware, lift inserts, weld-plates and reinforcing rebar will be inserted within the forms.

In one process a decorative pattern can be generated or the customer can create their own design pattern for the wall. The pattern is then projected down to the platform surface by the means of an overhead projector to create the exact repeating pattern for both front and back surfaces if desired. The decorative patterns for the back of the wall will be projected on the surface material on the rolling platform and the decorative patterns for the front will be projected on the concrete surface after it has been inserted into the wall forms. Additional Styrofoam shapes can be cut to be located on the surface and then removed after the concrete is cured to create design shapes through the wall. Reinforcing and accessory decorative components will be inset so as not to interfere with the decorative features on either side.

Additional design features will include tesserae or other transparent materials imbedded in to the surface of the concrete to be back lit by various lighting means including fiber optics. Plastic sleeves or removable cores are temporally affixed to the back of the tesserae or other transparent materials to be removed after the concrete has cured as a means to connect the lighting elements. Reinforcing and accessory decorative components will be inset so as not to interfere with the decorative features on either side.

Another design feature will have electrical or plumbing conduits and components imbedded in, through or on the surfaces of the wall prior to the placement of the concrete. In all cases the proprietary concrete mix will be placed in a manner so as not to disturb the inlayed decorative features.

After the concrete surface reaches the desired strength the forms will be stripped and the surface washed by a certified Enhanced Concrete Systems (ECS) technician to achieve the predetermined effect. An applicable curing compound will be applied if required on all surfaces. After 3000 psi is achieved on the off site or on site wall casting, the resulting wall panels can be stored or, if off site prefabrication is employed, moved to the construction site for installation. The wall panels will be power washed and acid etched if required. An additional densifying sealer can then be applied to all exposed surfaces.

After the wall panels have been erected and supported in place they will be shimmed to establish level, the required buttress support system will be poured at the back of the panels. A wide variety of conventional water proofing materials and drainage methods will be used on the back sides of the walls and buttress support system depending on the ground conditions, the height of the material retained and the height of the wall. Alternatively, the walls will be constructed utilizing a waterproofing admixture in the proprietary mix design.

An alternate embodiment of the Pre-cast Decorative Retaining Wall will be the Pre-cast Monument Wall or Pre-cast Concrete Fencing where concrete walls will be constructed on a horizontal surface normally at a manufacturing facility, preferably on the building site (on site), or on rolling platforms. Both sides of the fence wall can be decorated by utilizing the techniques described above for the reflection side (downside during casting) and the upside surfaces. These will be similar to the basic undecorated wall system or the decorative panel but will sit on a series of Pre-cast footing blocks having a slot to retain the wall segments or attached to an existing concrete surface, or upon conventional footings in the same configuration as the pre-cast blocks.

With respect to the above description then, it is to be realized that the optimum dimensional relationships for the parts of this application, to include variations in size, materials, shape, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Pre-cast Decorative Retaining Wall System. Further, since numerous modifications and changes will readily occur to those skilled in the art, it is not desired to limit, the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated, in and form a part of this specification, illustrate embodiments of the Pre-cast Decorative Retaining Wall and together with the description, serve to explain the principles of this application.

DETAILED DESCRIPTION OF THE PREFERRED EMBODIMENTS

Figures 1A, 1B:
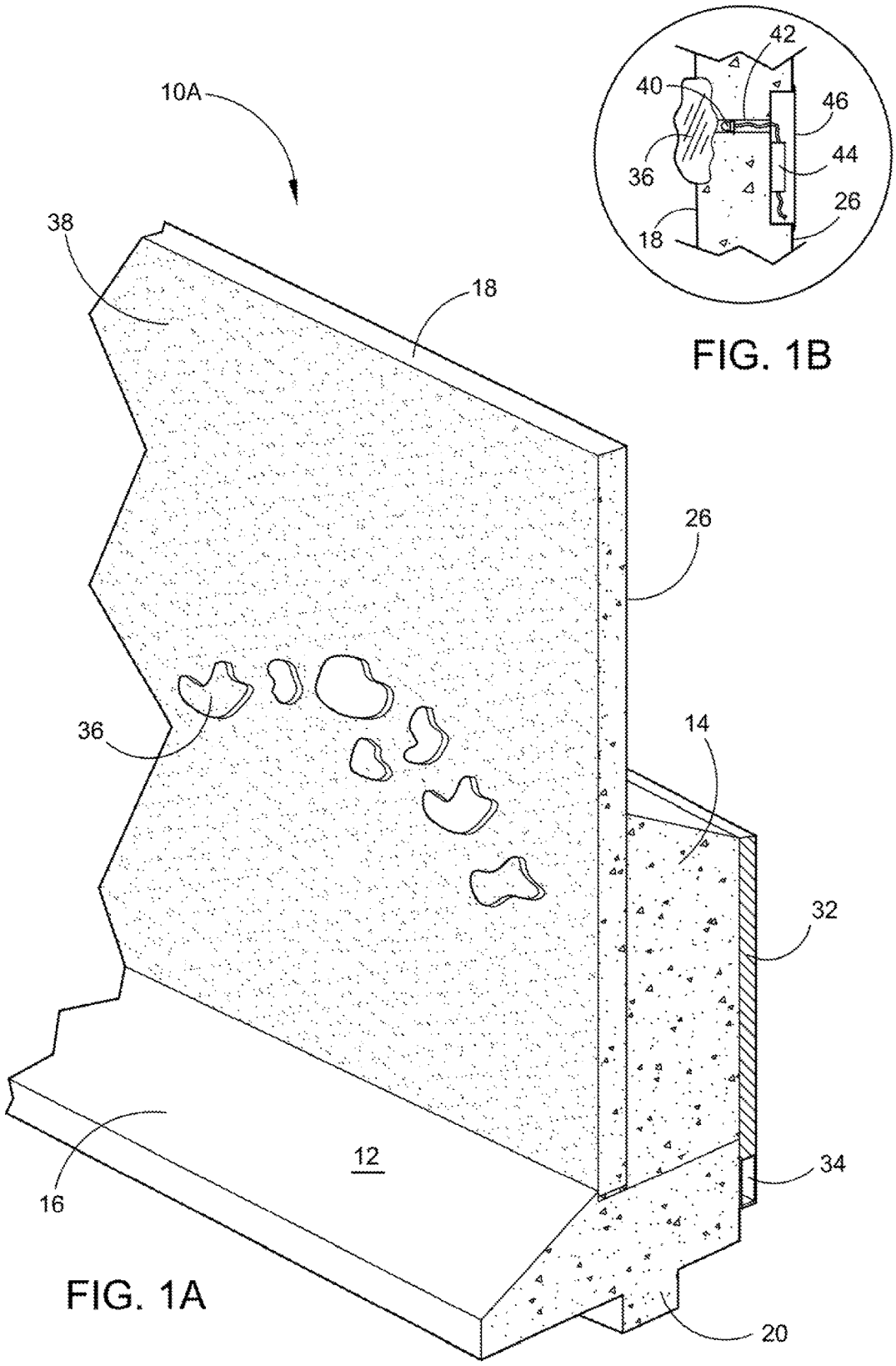
FIG. 1A depicts a perspective section view of the Pre-cast Decorative Retaining Wall on a footing with the buttress support.
FIG. 1B depicts a section through the Pre-cast Decorative Retaining Wall illustrating a transparent tesserae segment with a LED light wired through an orifice in the wall connected to an electronic control box embedded in the back side of the wall.

Referring now to the drawings, wherein similar parts of the Pre-cast Decorative Retaining Wall 10A, 10B and 10C are identified by like reference numerals, there is seen in FIG. 1A a perspective section view of the Precast Decorative Retaining Wall 10A on a footing 12 with the buttress support 14. The footing 12 will have a toe section 16 in front of the wall 18 and a footing, key 20 on the lower surface. Conventional waterproofing coatings will be applied to the wall back side 26 of the wall 18 and a water transmitting material 32 with a drainage cavity 34 at the bottom on the back side of the buttress support 14. Alternatively, a waterproofing, agent may be added to the concrete mix with only a drainage system required. A tesserae 36 wall design is illustrated on the front wall surface 38 of the wall 18. It should be understood that when constructed, the pre-cast wall may be readily decorated on either the front wall surface 38 or the wall back side 26 as desired.

FIG. 1B depicts a section through the Pre-cast Decorative Retaining Wall 10A illustrating a transparent tesserae 36 segment with a LED light 40 wired through an orifice 42 in the wall 18 connected to junction box 44 and an electronic control panel 46 embedded in the wall back side 26.

Figure 2:
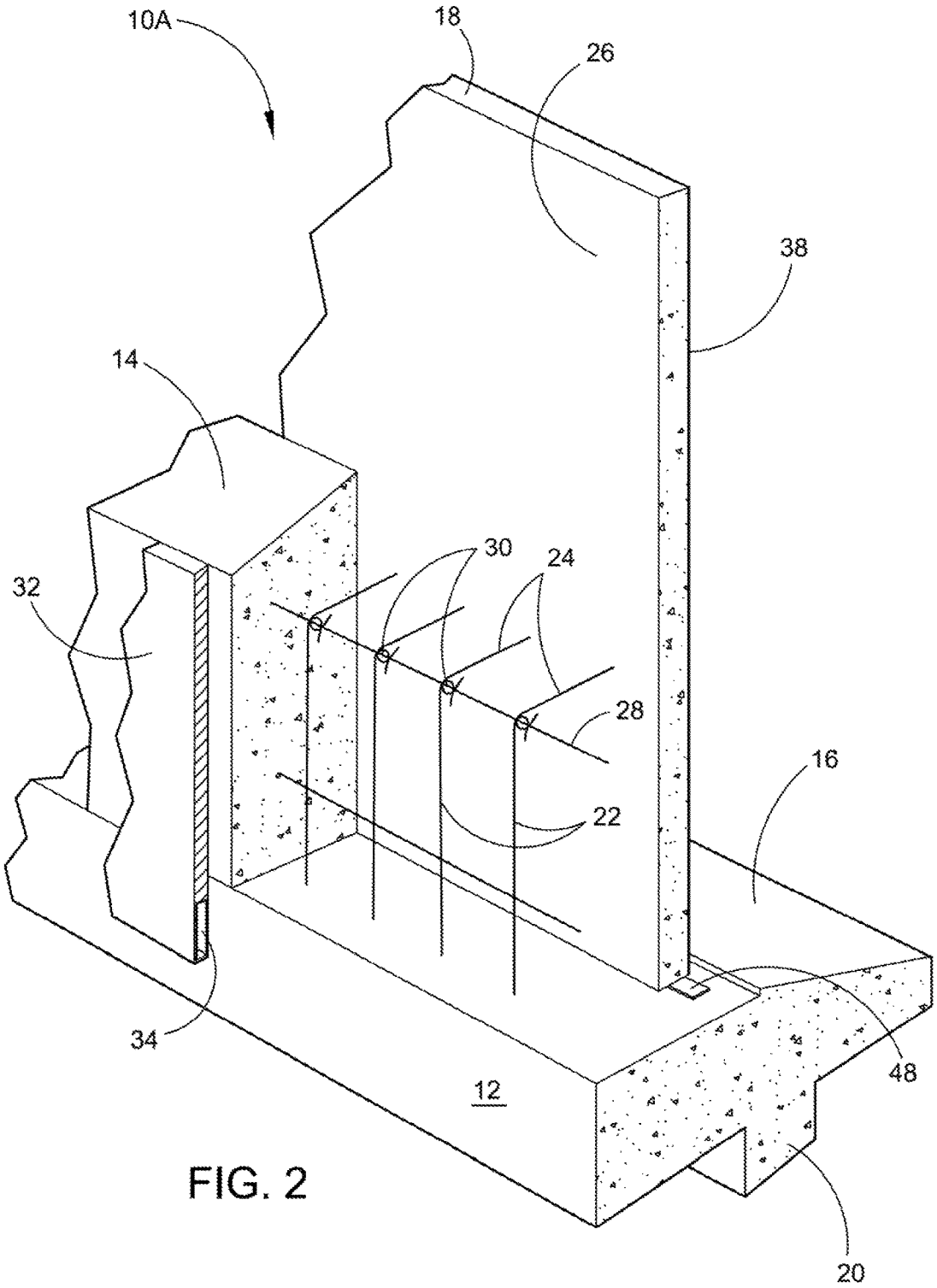
FIG. 2 depicts a perspective view of the back of the Pre-cast Decorative Retaining Wall illustrating the rebar reinforcing between the footing and the back of the wall.

FIG. 2 depicts a perspective view of the back of the Pre-cast Decorative Retaining Wall 10A illustrating, the reinforcement bar (hereafter "rebar") reinforcing pattern between the footing. 12 and the rebar extending from the wall back side 26. Rebar 24, a breakout bar, is left exposed at the rear of the wall to be lapped connected to rebut 22 extending from the footing 12. Horizontal rebar 28 in the buttress support 14 will extend through the overlapping connection 30 of the rebar 22 exposed at the rear of the footing 12 and the rebar 24 extending from the back side 26 of the wall 18. Shims 48 are inserted to level the each wall 18 segment prior to pouring the buttress support 14.

Figures 3A, 3B, 3C:
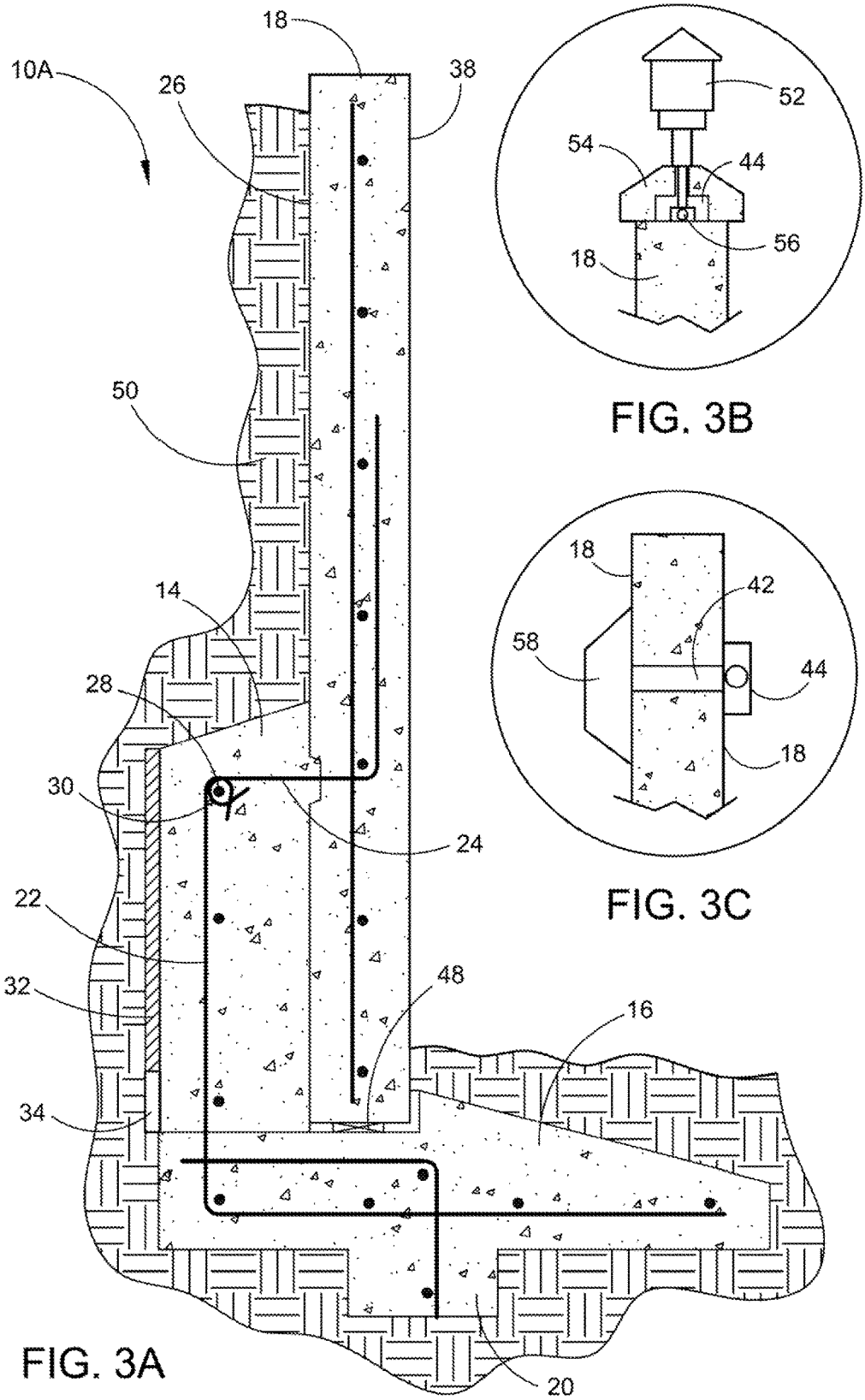
FIG. 3A depicts a cross section through the Pre-cast Decorative Retaining Wall illustrating the connection between the rebar coming from the back of the wall to the rebar in the footing.
FIG. 3B depicts a cross section through the top of the Pre-cast Decorative Retaining Wall with an electric light on top of a wall cap with the electrical conduit running through it.
FIG. 3C depicts a cross section through the top of the Pre-cast Decorative Retaining Wall with an electric light on the front face of the wall with the electrical connection running through an orifice in the wall to an electrical connection box on the back of the wall.

FIG. 3A depicts a cross section through the Pre-cast Decorative Retaining Wall 10A illustrating the lap connection between the rebar 24 coming from the back of the wall to the rebar 22 in the footing. Back fill material 50 extends to the top of the wall 18.

FIG. 3B depicts a cross section through the top of the Pre-cast Decorative Retaining Wall 10A with an electric light (or gas fixture) 52 on top of a wall cap 54 with the electrical conduit (or gas piping) 56 running through it.

FIG. 3C depicts a cross section through the top of the Pre-cast Decorative Retaining Wall 10A with a wall mount electric light 58 on the front face of the wall 18 with the electrical connection running through an orifice 42 in the wall 18 to an electrical junction box 44 on the wall back side 26. An option is to have a gas fixture utilizing the piping, orifice and gas fixture feature, in place of the electrical set-up shown here.

Figure 4A:
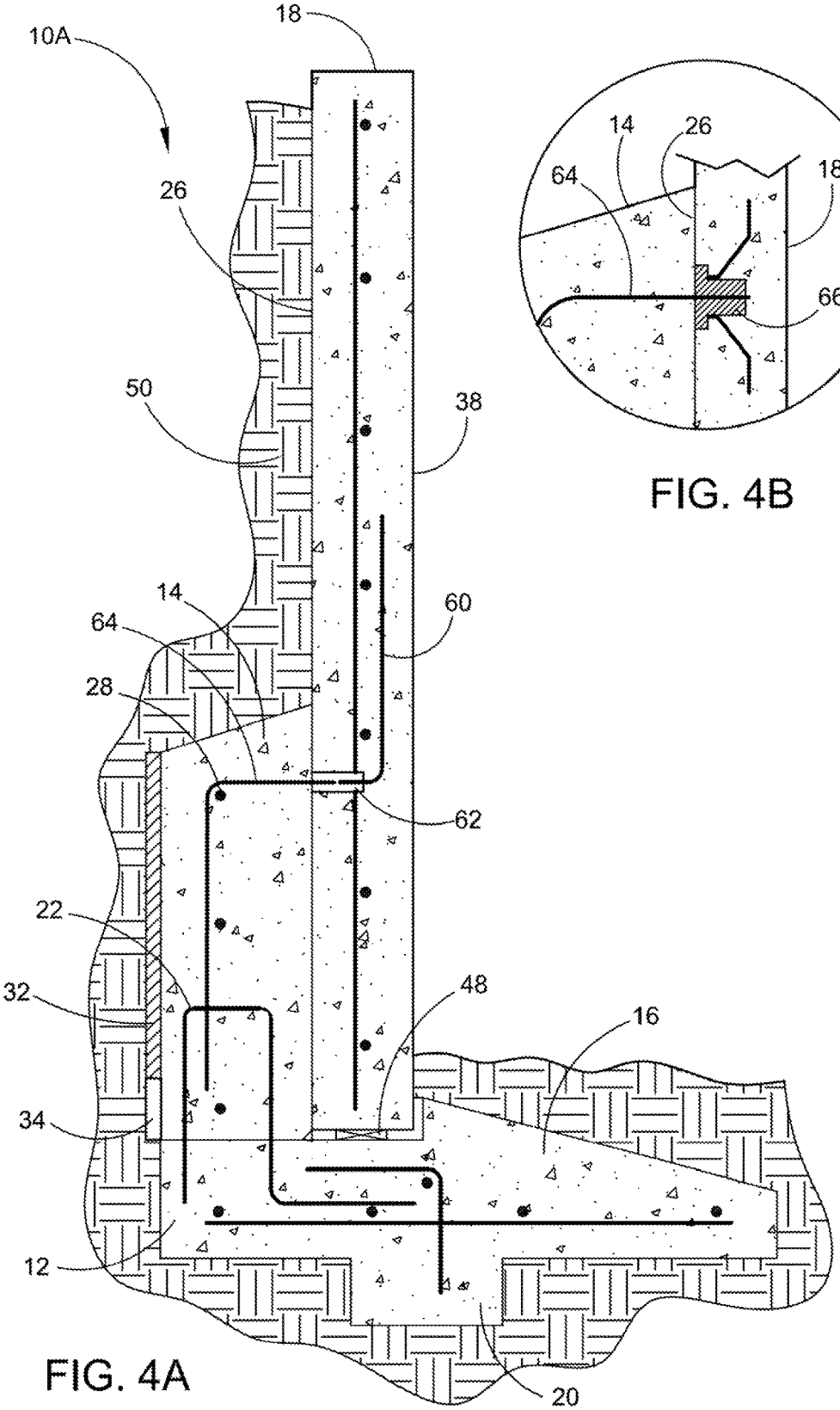
FIG. 4A depicts a cross section through the Pre-cast Decorative Retaining Wall illustrating the connection between the rebar coming from a Richmond Dowel type of concrete anchoring, system in the back of the wall to the rebar in the footing.

FIG. 4A depicts a cross section through the Pre-cast Decorative Retaining Wall 10A illustrating the connection between the rebar 60 on the inside of the wall 18 to the imbedded Richmond Dowel 62 (or other rebar splicing) type of concrete anchoring system in the wall back side 26. Pryor to pouring the concrete for the buttress system 14 rebar 64 extends over and around horizontal rebar 28 and down to be connected to the rebar 22 left exposed at the rear of the footing 12.

Figure 4B:
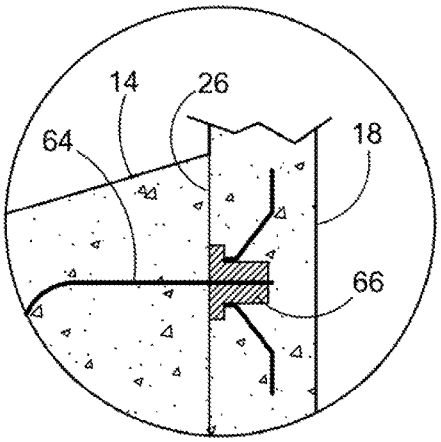
FIG. 4B depicts a cross section through the Pre-cast Decorative Retaining Wall illustrating, the connection between the rebar coming from an additional type of concrete anchoring system in the back of the wall to the rebar in the footing.

FIG. 4B depicts a cross section through the Pre-cast Decorative Retaining Wall 10A illustrating the connection between the rebar 64 coming from an additional type of concrete anchoring system 66 in the wall back side 26 to the rebar 22 in the footing.

Figure 5:
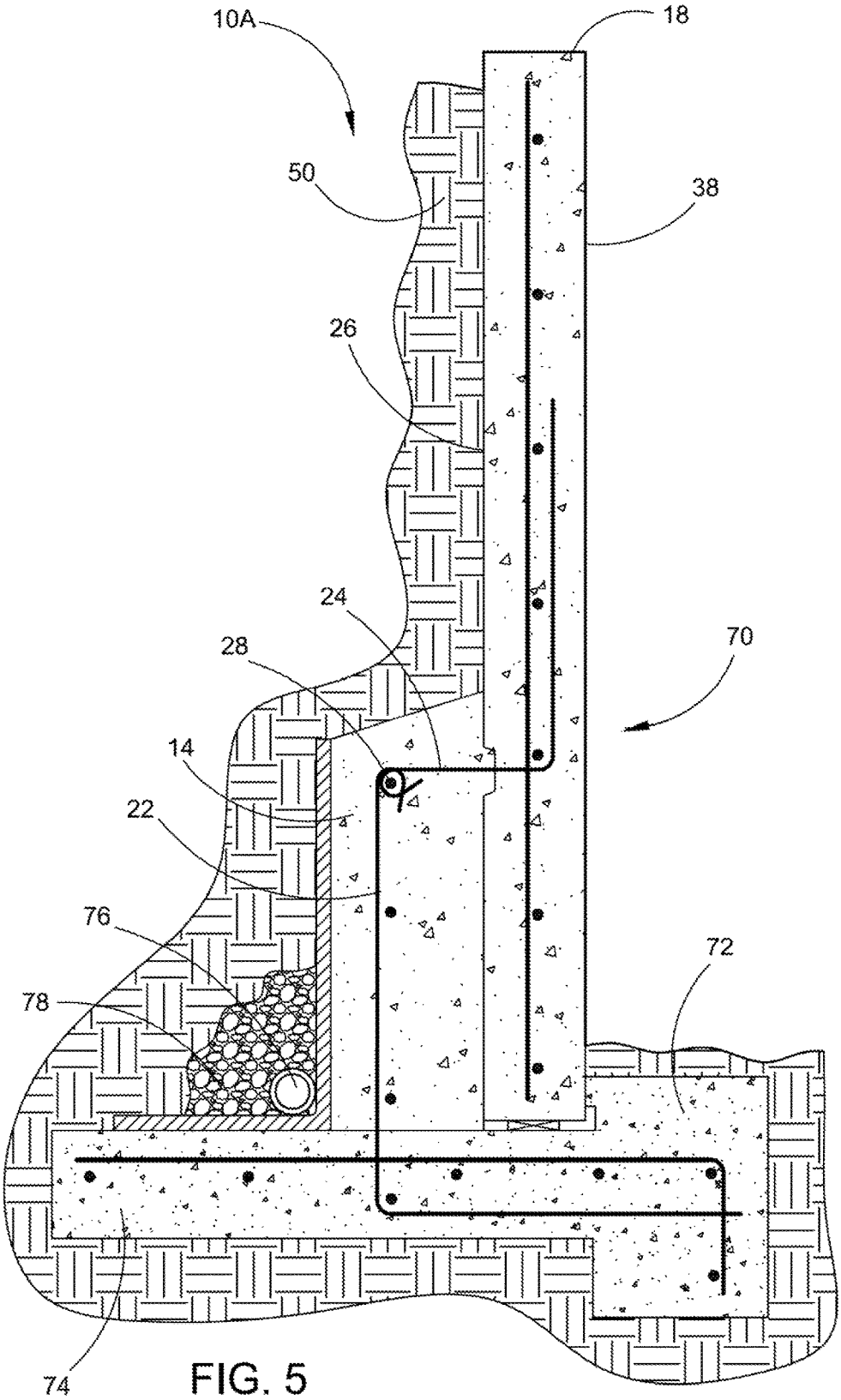
FIG. 5 depicts a cross section through the Pre-cast Decorative Retaining Wall illustrating a different style of footing with a shorter toe and an extended back section having a drain line with a gravel covering.

FIG. 5 depicts a cross section through the Pre-cast Decorative Retaining Wall 10A illustrating a different style of footing 70 with a shorter toe 72 and an extended footing back section 74 having, a drain line 76 with a gravel covering 78.

Figure 6:
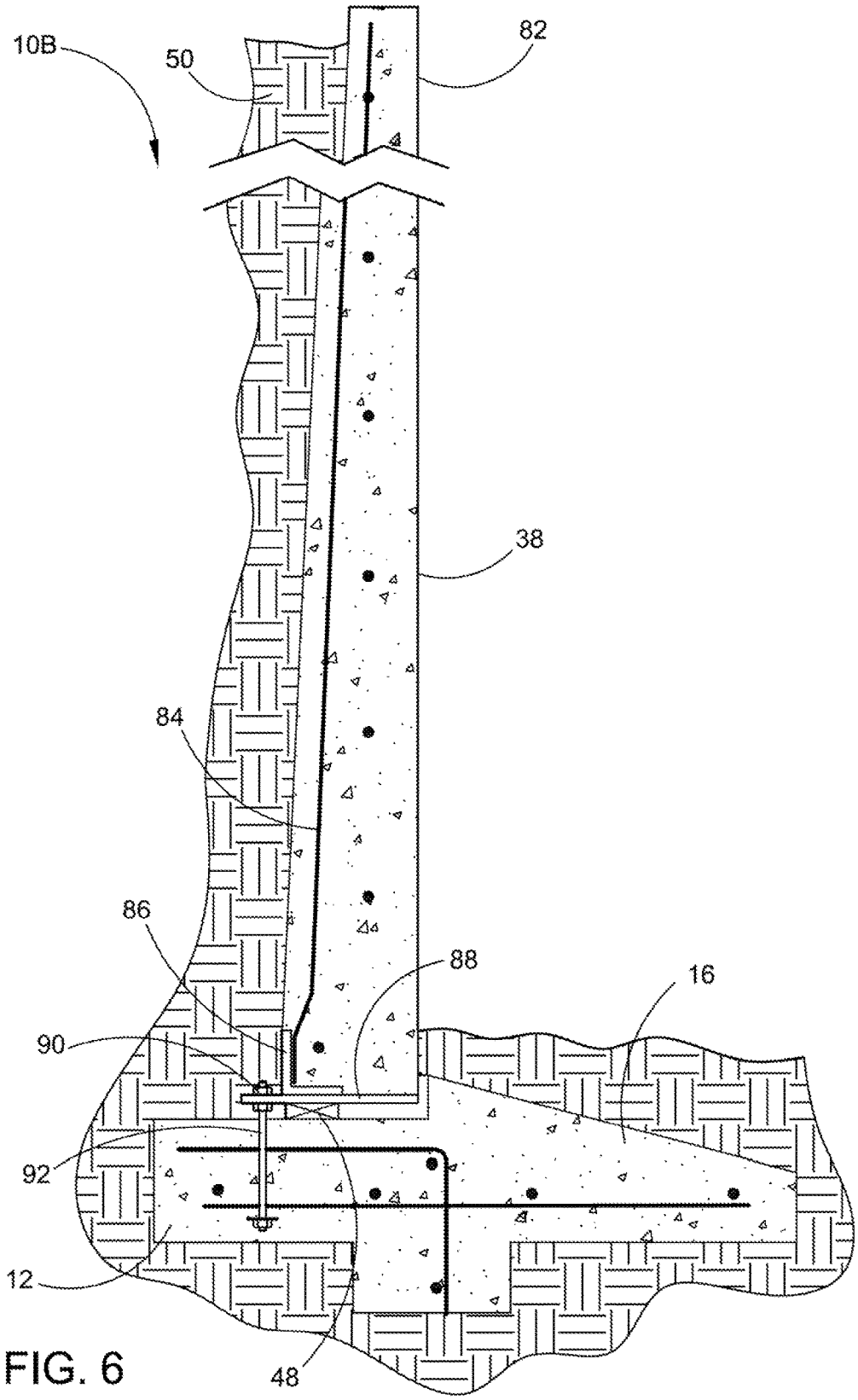
FIG. 6 depicts a cross section through the Pre-cast Decorative Retaining Wall illustrating a tapered wall anchored to the footing without the buttress support system.

FIG. 6 depicts a cross section through the Pre-cast Decorative Retaining Tapered Wall 10B illustrating a tapered wall 82 anchored to the footing 12 without the buttress support system 14. The tapered wall 82 is anchored to the footing 12 by the means of the wall internal rebar 84 welded to a steel angle 86 and a jacking plate 88 running the length of the tapered wall 82. Jacking nuts 90 on a threaded rod (or threaded bent rebar) 92 will establish the vertical aspect of the tapered wall 82 and shims 48 will establish the level position.

Figure 7A:
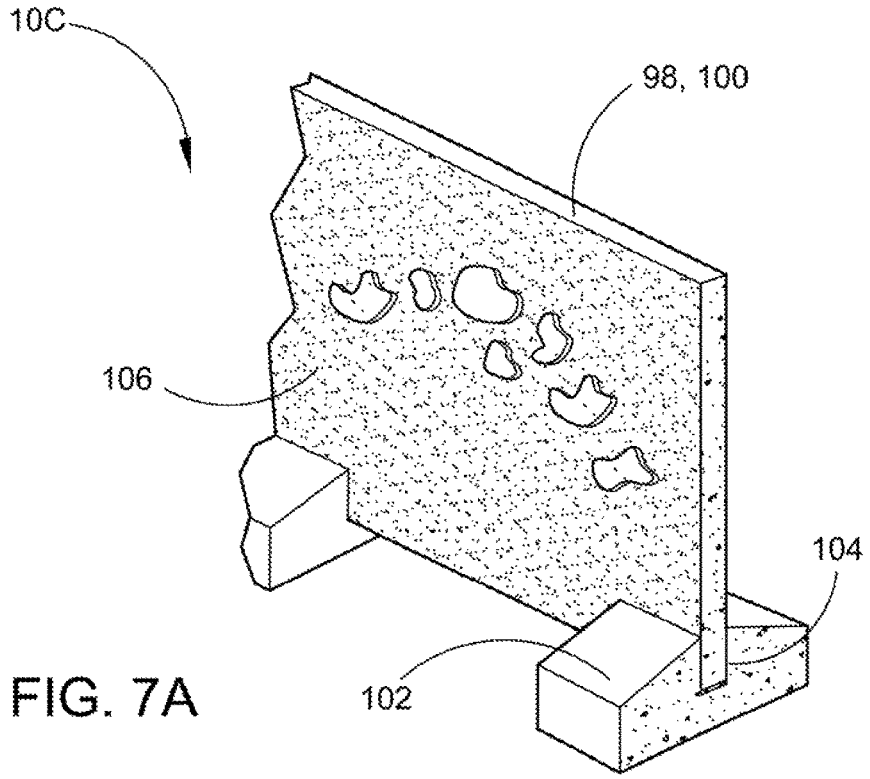
FIG. 7A depicts a perspective view of the Pre-cast Decorative Retaining Wall in the form of Pre-cast, or cast in place Monument Wall or Pre-cast, or cast in place Concrete Fencing (a non-retaining wall configuration) resting on numerous separate individual spaced-apart Pre-cast, or cast in place footing blocks each having slots to accept and retain the wall segments.

FIG. 7A depicts a perspective view of a short Pre-cast Decorative Non-Retaining Wall 10C in the form of Pre-cast, or cast in place Monument Wall 98 or Pre-cast Concrete Fencing 100 resting on Pre-cast, or cast in place footing blocks 102 having a wall slot 104 to retain the decorative wall segment 106.

Figure 7B:
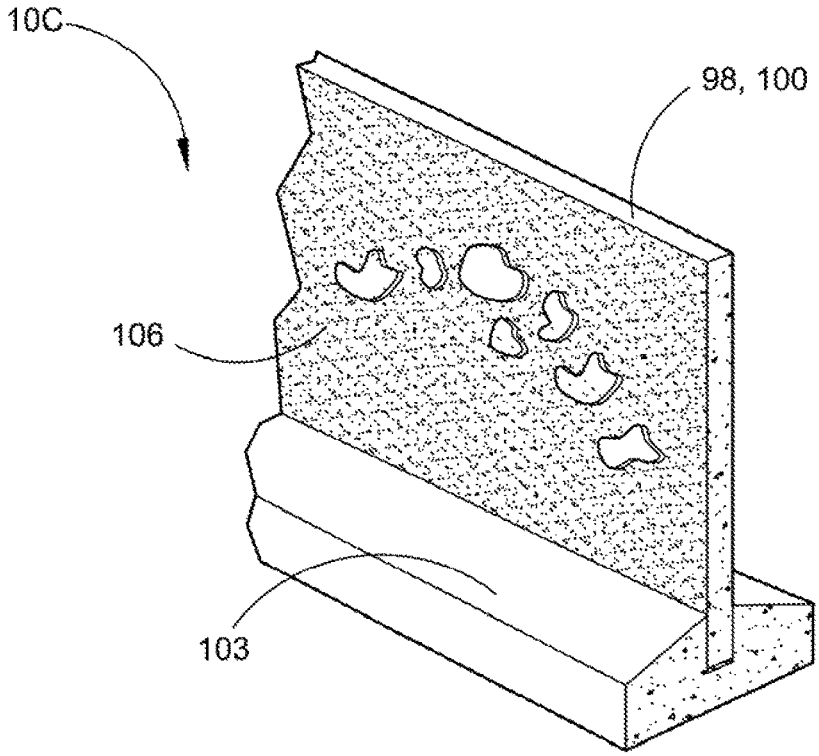
FIG. 7B depicts a perspective view of the Pre-cast Decorative Retaining Wall in the form of Pre-cast, or cast in place Monument Wall or Pre-cast, or cast in place Concrete Fencing (a non-retaining wall configuration) resting on a continuous Pre-cast, or cast in place footing block having a continuous slot, to retain the wall segments.

FIG. 7B depicts a perspective view of the Pre-cast Decorative Non-Retaining Wall 10C in the form of Pre-cast Monument Wall or Pre-cast Concrete Fencing resting on a continuous Pre-cast, or cast in place footing block 103 having; a continuous slot to retain the wall segments.

Figure 8:
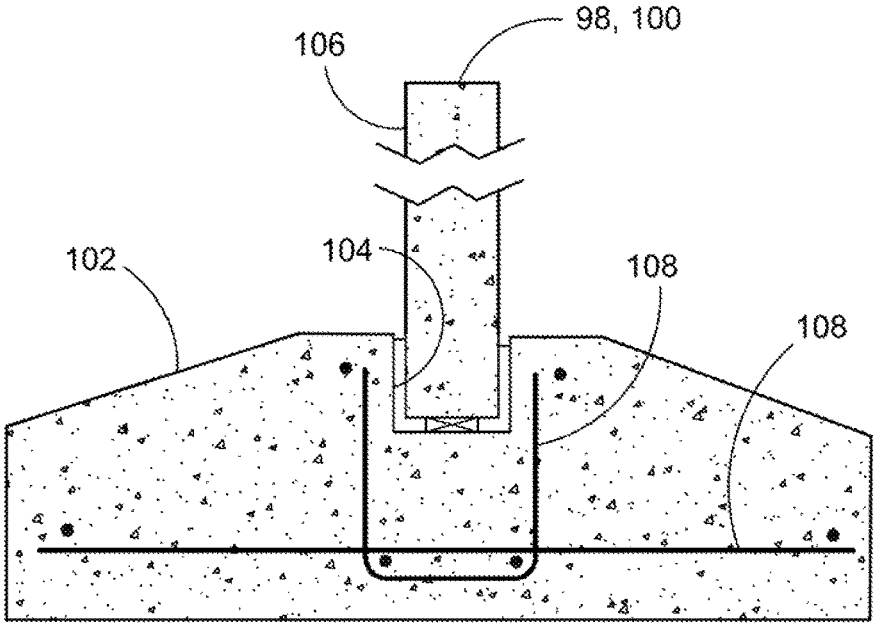
FIG. 8 depicts a cross section through the Pre-cast Decorative Non-Retaining Wall in the form of Pre-cast, or cast in place Monument Wall or Pre-cast, or cast in place Concrete Fencing resting on Pre-cast, or cast in place footing blocks having a slots to retain the wall segments along with the rebar reinforcing members.

FIG. 8 depicts a cross section through a of Pre-cast Decorative Non-Retaining Wall 10C in the form of Pre-cast, or cast in place Monument Wall 98 or Pre-cast Concrete Fencing 100 resting on Pre-cast, or cast in place footing blocks 102 having a wall 104 slot to retain the wall segments 106 along with the rebar reinforcing members 108.

Figure 9:
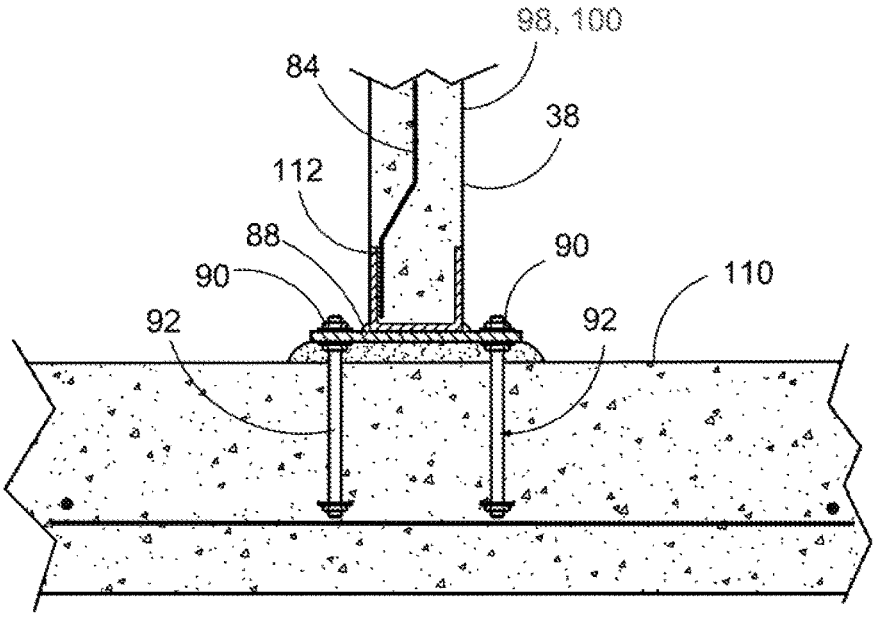
FIG. 9 depicts a cross section through a short portion of the Pre-cast Decorative Retaining Wall with steel angle or channel inserted into the bottom of the wall conventionally anchored to a concrete slab.

FIG. 9 depicts a cross section through a short use of the Pre-cast Decorative Retaining Wall 10C with the wall internal rebar 84 welded to the steel angle or channel 112 welded to the jacking plate 88. Jacking nuts 90 on a threaded rod 92 will establish the vertical aspect of the tapered wall 98, 100 conventionally anchored to a concrete slab.

Figure 10A:
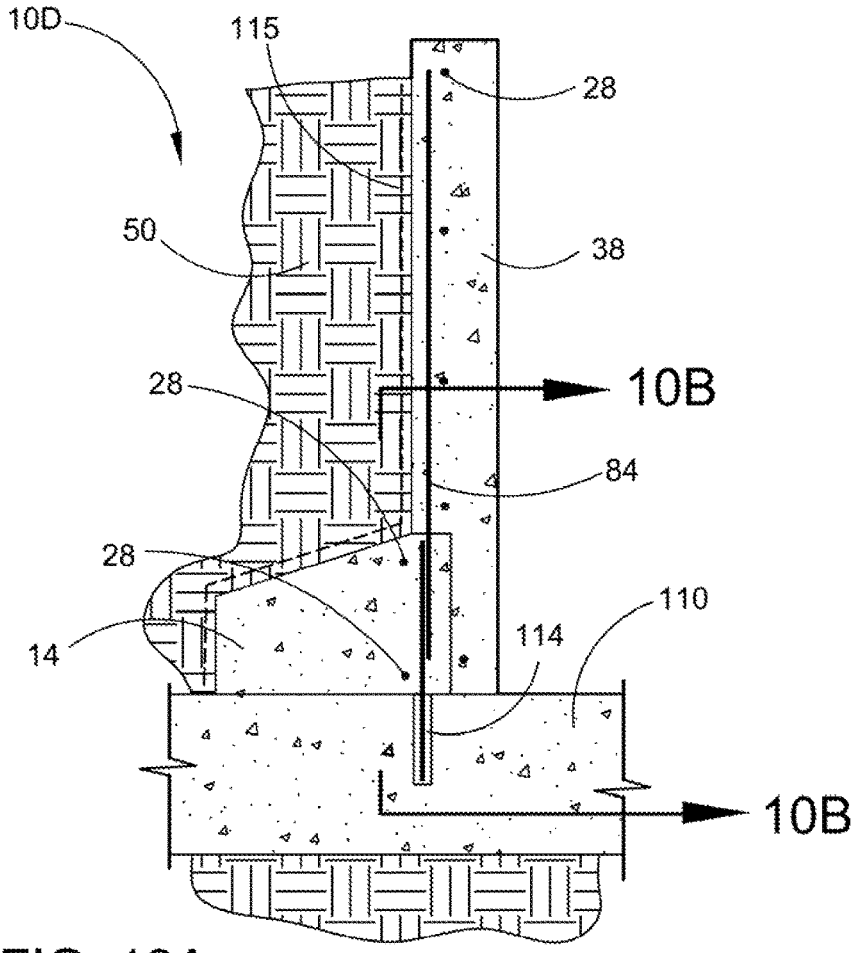
FIG. 10A depicts a cross section through the Pre-cast Decorative Retaining Wall in the form of Pre-cast Monument Wall or Pre-cast Concrete Fencing resting on an existing concrete deck surface.

FIG. 10A depicts a cross section through the Pre-cast Decorative Retaining Wall 10D in the form of Pre-cast Monument Wall or Pre-cast Concrete Fencing resting on an existing concrete deck surface 110. This configuration can be used to construct planter boxes and the like. Waterproof barrier 115 in the soil 50 side is used to allow water to run down to buttress support system 14 and out existing drains (not shown). Rebar 114 runs from the buttress support system 14 an into a drill hole within the existing podium deck 110, to secure the Pre-cast Monument Wall or Pre-east Concrete Fencing resting on the existing concrete deck surface 110.

Figure 10B:
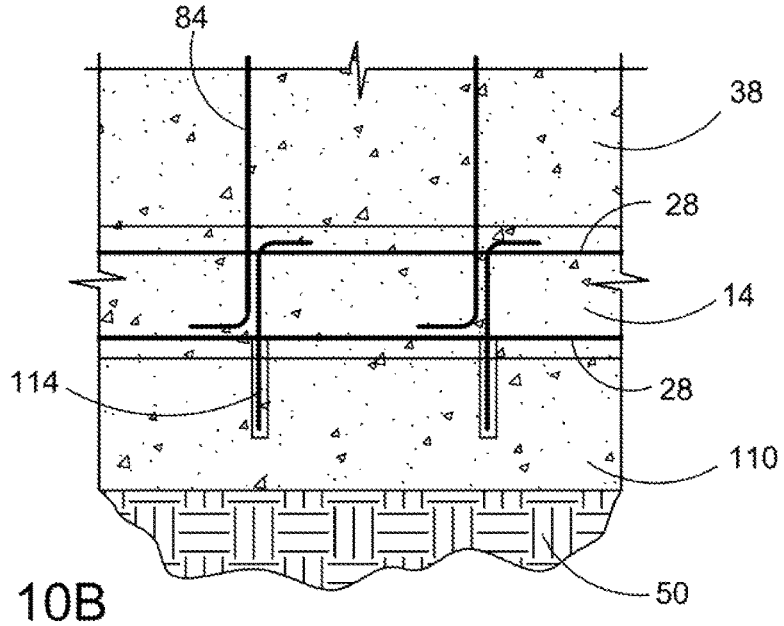
FIG. 10B depicts a front sectional view of FIG. 10A of the Pre-cast Decorative Retaining Wall in the form of Pre-cast Monument Wall or Pre-cast Concrete Fencing resting on an existing concrete deck surface.

FIG. 10B depicts a front sectional view of FIG. 10A of the Pre-cast Decorative Retaining Wall 100 in the form of Pre-cast Monument Wall or Pre-cast Concrete Fencing resting on an existing concrete deck surface 110. Rebar 84 is bent inside, buttress support system 14, as is rebar 114 which extends down from buttress support system 14 into the existing podium deck 110 inside a drill hole, to secure the planer box or the like constructed in this fashion.

Figure 11:
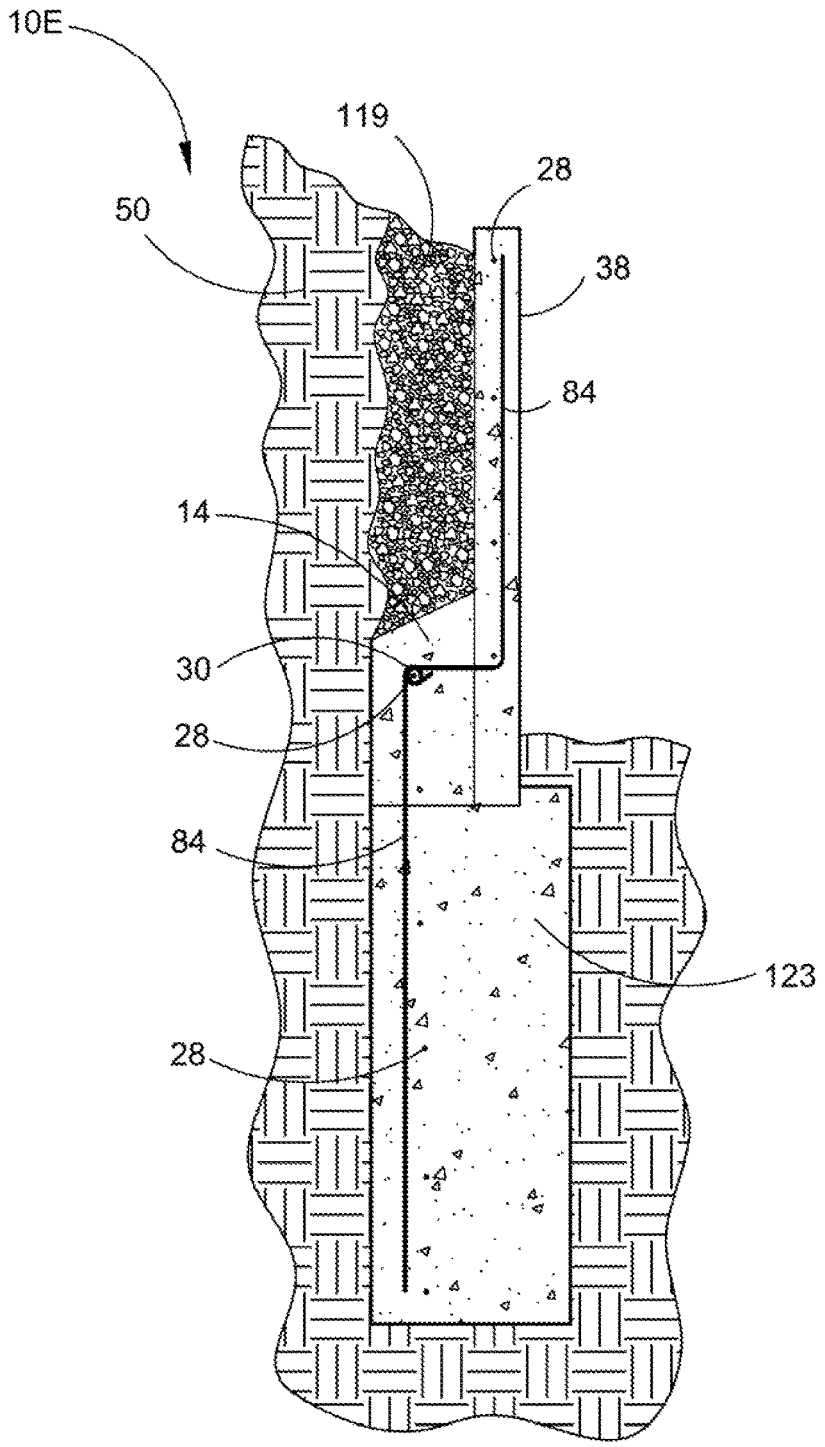
FIG. 11 depicts a cross section through the Pre-cast Decorative Retaining Wall in the form of Pre-cast Monument Wall or Pre-cast Concrete Fencing in a true cantilever configuration on piers or a continuous footing.

FIG. 11 depicts a cross section through the Pre-cast Decorative Retaining Wall. 101 in the form of Pre-cast Monument Wall or Pre-cast Concrete Fencing, in a true cantilever configuration on piers or a continuous footing 123. This configuration includes a backfill of gravel 119 behind the wall 38 and above the buttress support system 14 for efficient drainage.

Figure 12:
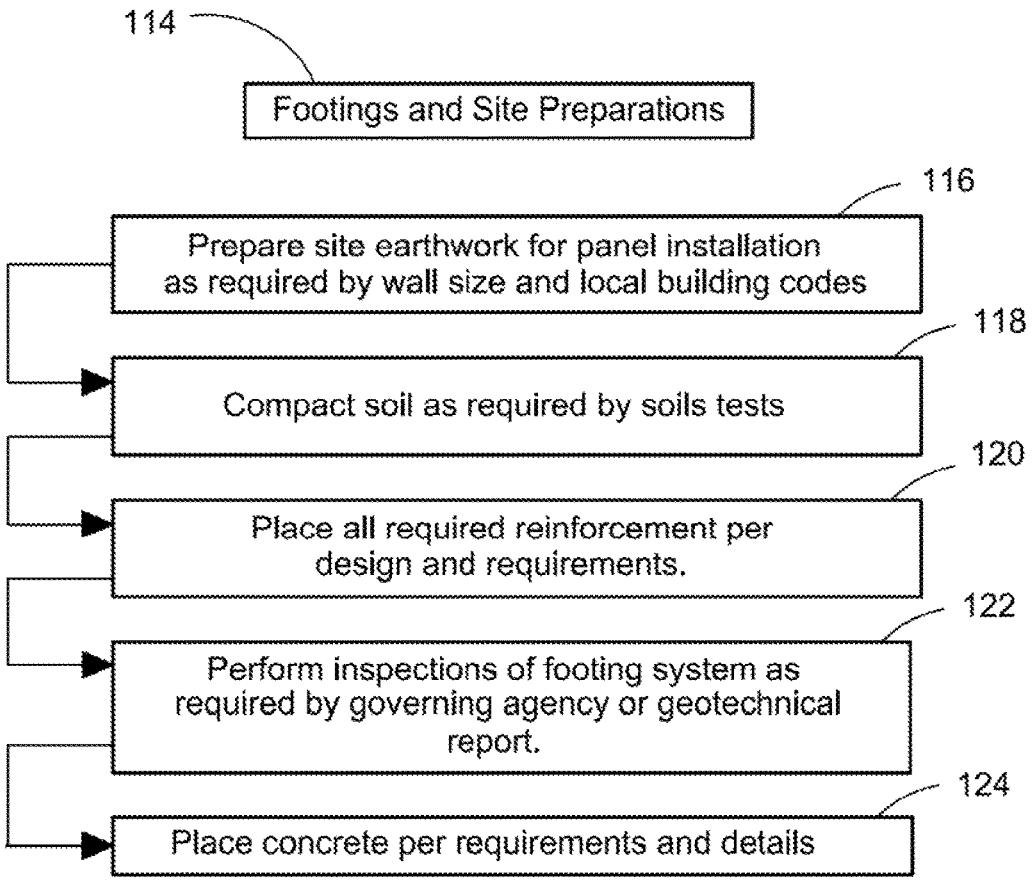
FIG. 12 depicts a block diagram describing steps of the footing site preparation.

FIG. 12 depicts a block diagram describing steps of the footing site preparation 114 where the first step 116 is to prepare the earthwork for panel installation as required by wall size and local building codes. The second step 118 is to compact the soil as required by the soils tests. The third step 120 is to place the required reinforcement per the design requirements. The fourth step 122 is to perform the inspections of the footing system as required by governing agency or geotechnical report. The fifth step 124 is to place the concrete per the requirements and details.

Figure 13:
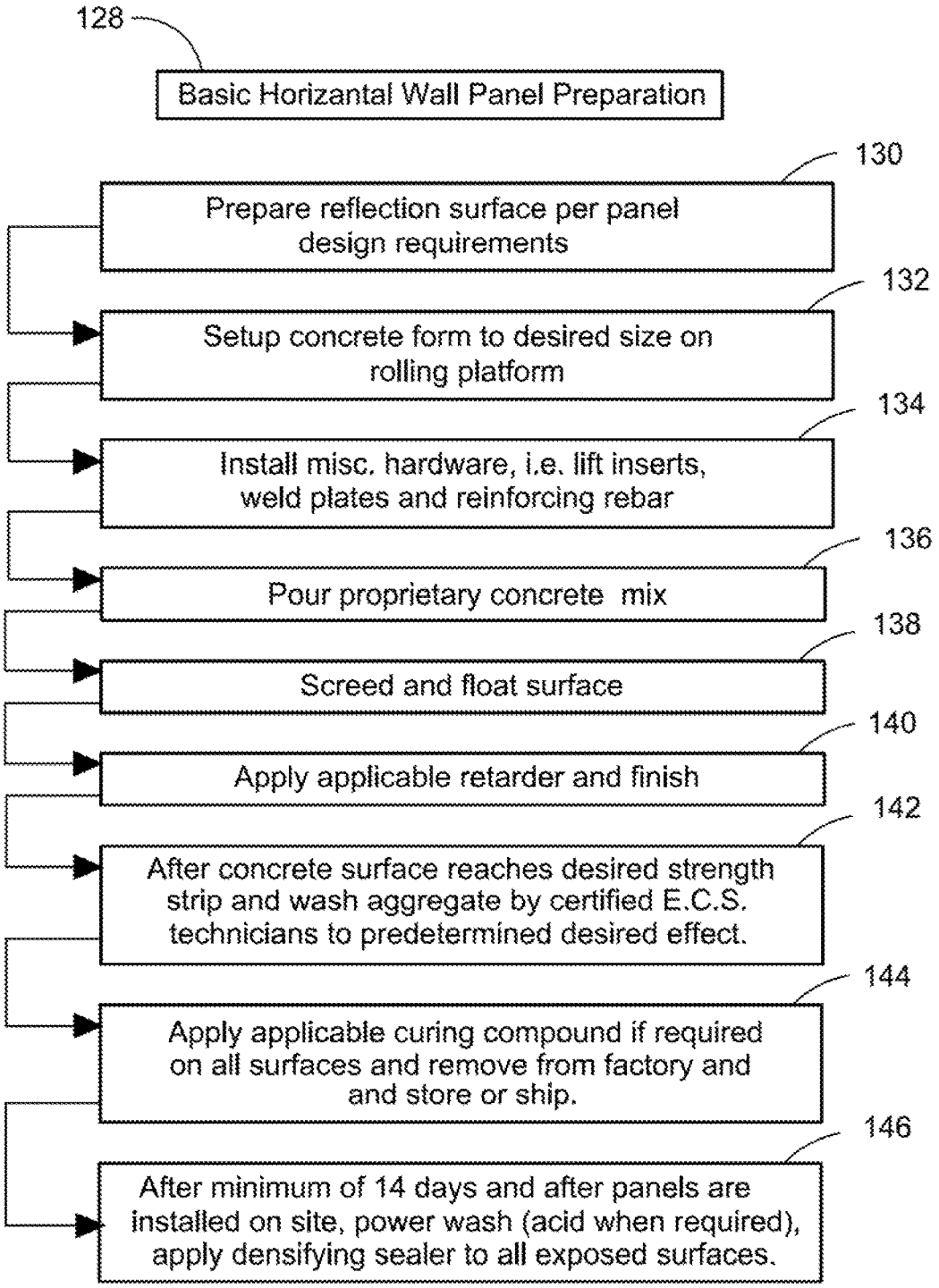
FIG. 13 depicts a block diagram describing steps of the basic horizontal wall panel preparation on a rolling platform.

FIG. 13 depicts a block diagram describing steps of the basic horizontal wall panel preparation 128 where the first step 130 is to prepare the reflection surface per panel design requirements. The second step 132 is to setup concrete forms to the desired size on the reflection surface. The third step 134 is to install the miscellaneous hardware i.e. lift inserts, weld plates and reinforcing rebar. The fourth step 136 is to pour proprietary concrete mix. The fifth step 138 is to screed and float the surface. The sixth step 140 is to apply the applicable retarder. The seventh step 142 is after the concrete surface reaches desired strength strip and wash aggregate surface by certified ECS technicians to predetermined desired effect. The eighth step 144 is to apply applicable curing compound if required on all surfaces and remove from factory and store or ship. The ninth step 146 is after a minimum of 14 days and after the panels are installed on site, power wash (acid when required) apply densifying sealer to all exposed surfaces.

Figure 14A:
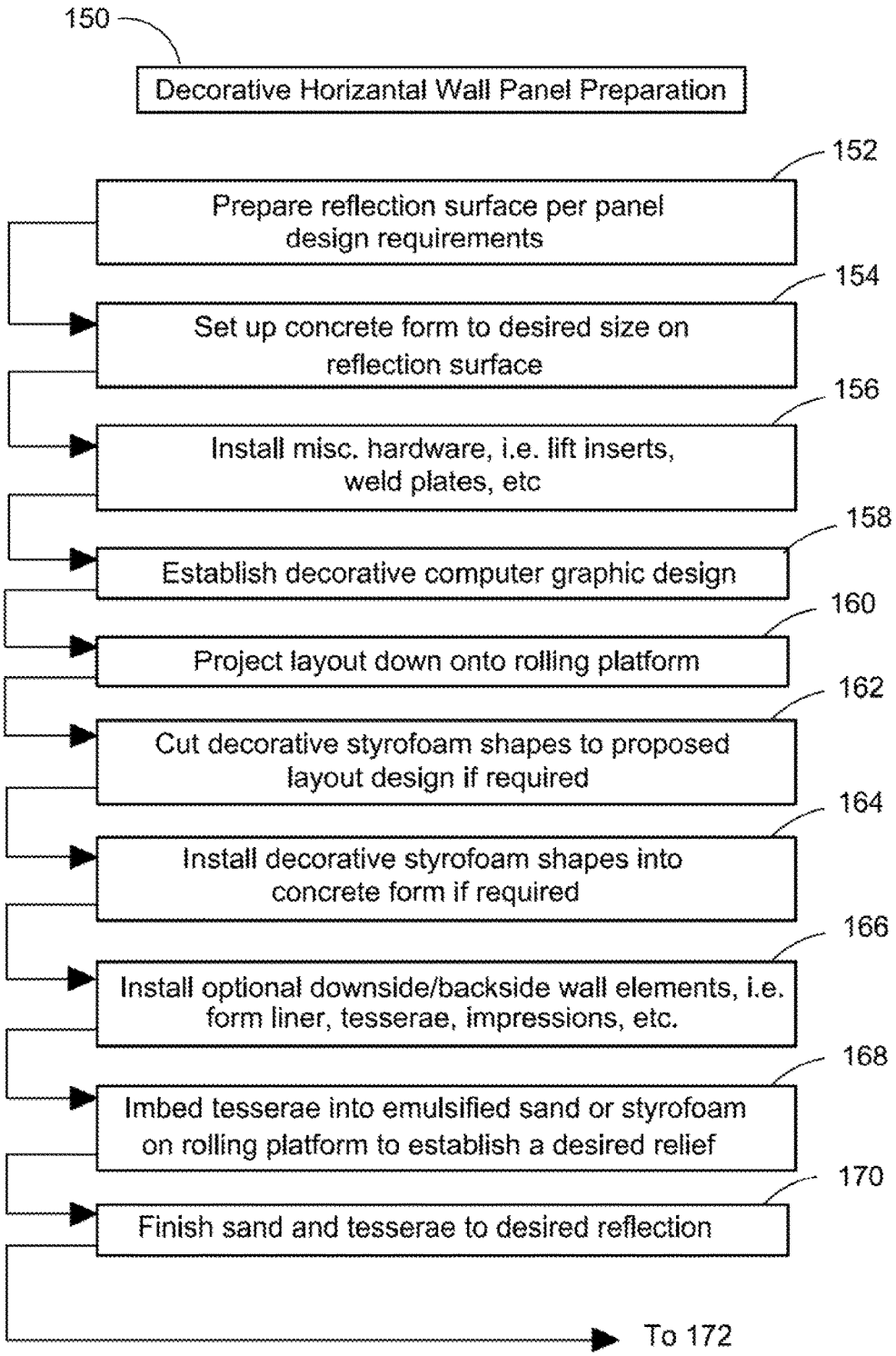
FIG. 14A depicts a block diagram describing steps of the decorative horizontal wall panel preparation.

FIG. 14A depicts a block diagram describing steps of the decorative horizontal wall panel preparation 150 where the first step 152 is to prepare the reflection surface per panel design requirements. The second step 154 is to up concrete forms to the desired size on the reflection surface. The third step 156 is to install miscellaneous hardware i.e. lift inserts weld plates, etc. The fourth step 158 is to establish decorative computer graphic design. The fifth step 160 is to project layout down onto reflection surface. The sixth step 162 is to cut decorative Styrofoam shapes to proposed layout design if required. The seventh step 164 is to install Styrofoam shapes into concrete form if required. The eighth step 166 is to install optional downside/backside wall elements i.e. form liner, tesserae, impressions, etc. The ninth step 168 is to imbed tesserae into emulsified sand or Styrofoam on the reflection surface to establish desired relief. The tenth step 170 is to finish emulsified sand and tesserae to desired reflection. The eleventh step 172 is to place or implant reinforcing and accessory decorative components so as not to interfere with decorative features on either side.

Figure 14B:
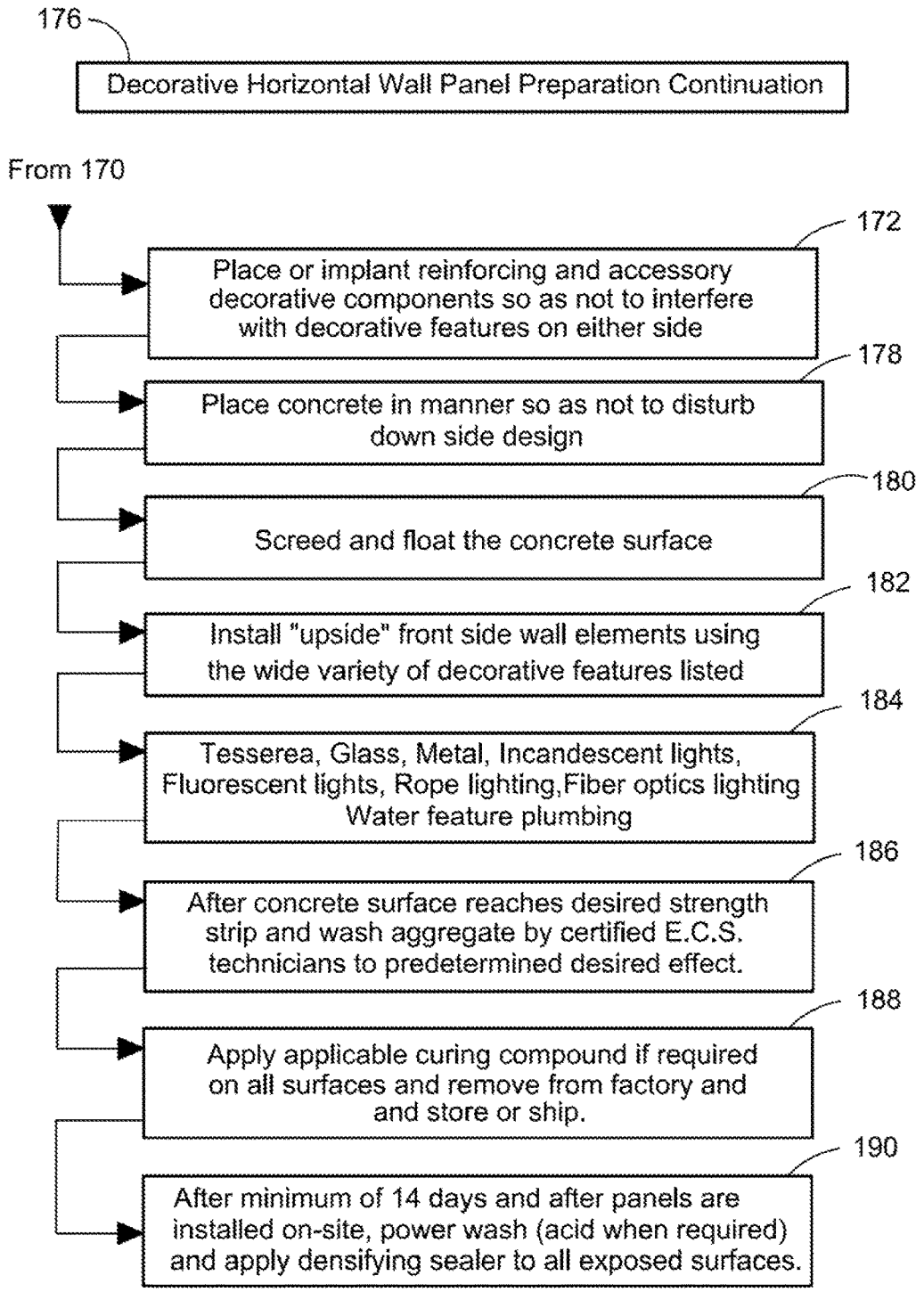
FIG. 14B depicts a block diagram describing steps of the continuation of the decorative horizontal wall panel preparation.

FIG. 14B depicts a block diagram describing steps of the continuation of the decorative horizontal wall panel preparation 176 where the twelfth step 178 is to place concrete in a manner so as not to disturb down side design. The thirteenth step 180 is to screed and float the concrete surface. The fourteenth step 182 is to install "upside" front side wall elements using the wide variety of decorative features listed. The fifteenth step 184 is to install tesserae, glass, metal, incandescent lights, fluorescent lights, rope lighting, fiber optic lighting and water or gas feature plumbing. The sixteenth step 186 is after concrete surface reaches desired strength strip and wash aggregate surface by certified ECS technicians to predetermined desired effect. The seventeenth step 188 is to apply applicable curing compound if required on all surfaces and remove from factory and store or ship. The eighteenth step 190 after a minimum of 14 days and after panels are installed on site, power wash (acid when required) and apply densifying sealer to all exposed surfaces. It should be emphasized that following this method result in substantial time savings over conventional retaining wall installation methods and construction techniques.

The Pre-cast Decorative Retaining Wall 10A, 10B, 10, 10D and 10E shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Pre-cast Decorative Retaining Wall 10A, 10B, 10C, 10D and 10E in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are familiar with patent or legal terms and phraseology, to determine quickly from a cursory inspection the nature and essence of the technical disclosure of the application, which is measured by the claims, nor is it intended to be limiting as to the scope of the invention in any way.

We claim:

1. A pre-cast continuous and horizontal retaining wall three-component system comprising:

a) a first system component comprising one or more continuous and horizontal poured concrete footing members including a concrete wall accepting portion capable of supporting a pre-cast concrete wall placed thereon;

b) a second system component comprising one or more pre-cast concrete walls having a front wall surface and a wall back side, constructed by casting on a horizontal surface, wherein said pre-cast concrete wall is mounted on said one or more continuous and horizontal poured concrete footing members;

c) a plurality of reinforcement bars wherein said reinforcement bars are attached to said concrete wall, and said reinforcement bars are attached to said concrete footing and extending therebetween; and d) a third system component comprising one or more continuous and horizontal concrete buttress support portions poured on top of said one or more continuous and horizontal concrete footing members and adjacent to said wall back side, thereby connecting the wall back side to said footing, by embedding said attached plurality of reinforcement bars, extending between said concrete wall and said concrete footing, within said concrete buttress support portions, when said concrete buttress support portions are poured, to secure the concrete wall and enable retaining wall characteristics throughout the structure of said continuous and horizontal retaining wall system.

2. The pre-cast continuous and horizontal retaining wall three-component system according to claim 1, wherein said one or more pre-cast concrete walls include decorative features integrated on said front wall surface and said wall back side during the construction by casting on a horizontal surface process.

3. The pre-cast continuous and horizontal retaining wall three-component system according to claim 1, wherein said pre-cast concrete walls include electrical conduit and lighting features integrated therein during the casting process.

4. The pre-cast continuous and horizontal retaining wall three-component system according to claim 1, wherein said pre-cast concrete walls include water piping and water features and gas piping and gas features integrated therein during the casting process.

5. The pre-cast continuous and horizontal retaining wall three-component system according to claim 1, wherein said reinforcement bar attached to said pre-cast concrete wall, and said reinforcement bar attached to said concrete footing, are inter-connected to secure said pre-cast concrete wall to said footing.

6. The pre-cast continuous and horizontal retaining wall three-component system according to claim 5, wherein said reinforcement bar attached to said pre-cast concrete wall, and said reinforcement bar attached to said concrete footing, are connected by bending and hooking said reinforcement bar.

7. The pre-cast continuous and horizontal retaining wall three-component system according to claim 5, wherein said reinforcement bar attached to said pre-cast concrete wall, and said reinforcement bar attached to said concrete footing, are connected by bending and lapping said reinforcement bar.

8. The pre-cast continuous and horizontal retaining wall three-component system according to claim 1, wherein said reinforcement bar attached to said pre-cast concrete wall, and said reinforcement bar attached to said concrete footing, are embedded into said concrete buttress support portion poured onto said footing.

9. The pre-cast continuous and horizontal retaining wall three-component system according to claim 1, wherein said one or more continuous and horizontal pre-cast concrete wall is mounted on one continuous and horizontal poured footing and is configured as a non-retaining monument wall and concrete fence.

10. A method for making a continuous and horizontal pre-cast three-component retaining wall system comprising the steps of:

a) providing a first system component comprising one or more continuous and horizontal poured concrete footing members including a concrete wall accepting portion capable of supporting a pre-cast concrete wall placed thereon;

b) providing a second system component comprising one or more pre-cast concrete walls having a front wall surface and a wall back side, constructed by casting on a horizontal surface, wherein said pre-cast concrete wall is mounted on said one or more continuous and horizontal poured;

c) providing a plurality of reinforcement bars wherein said reinforcement bars are attached to said concrete wall, and said reinforcement bars are attached to said concrete footing and extending therebetween; and d) providing a third system component comprising one or more concrete buttress support portions poured on the concrete footing members and adjacent to said wall back side, thereby connecting the wall back side to said footing, by embedding said attached plurality of reinforcement bars, extending between said concrete wall and said concrete footing, within said concrete buttress support portions, when said concrete buttress support portions are poured, to secure the concrete wall and enable retaining wall characteristics throughout the structure of said continuous and horizontal retaining wall system.

11. The method for making pre-cast continuous and horizontal retaining wall three-component system according to claim 10, wherein said one or more pre-cast concrete walls include decorative features integrated on said front wall surface and said wall back side during the construction by casting on a horizontal surface process.

12. The method for making pre-cast continuous and horizontal retaining wall three-component system according to claim 10, wherein said pre-cast concrete walls include electrical conduit and lighting features integrated therein during the casting process.

13. The method for making pre-cast continuous and horizontal retaining wall three-component system according to claim 10, wherein said pre-cast concrete walls include water piping and water features and gas piping and gas features integrated therein during the casting process.

14. The method for making pre-cast continuous and horizontal retaining wall three-component system according to claim 10, wherein said reinforcement bar attached to said pre-cast concrete wall, and said reinforcement bar attached to said concrete footing, are inter-connected to secure said pre-cast concrete wall to said footing.

15. The method for making pre-cast continuous and horizontal retaining wall three-component system according to claim 14, wherein said reinforcement bar attached to said pre-cast concrete wall, and said reinforcement bar attached to said concrete footing, are connected by bending and hooking said reinforcement bar.

16. The method for making pre-cast continuous and horizontal retaining wall three-component system according to claim 14, wherein said reinforcement bar attached to said pre-cast concrete wall, and said reinforcement bar attached to said concrete footing, are connected by bending and lapping said reinforcement bar.

17. The method for making pre-cast continuous and horizontal retaining wall three-component system according to claim 10, wherein said reinforcement bar attached to said pre-cast concrete wall, and said reinforcement bar attached to said concrete footing, are embedded into said concrete buttress support portion poured onto said footing.

18. The method for making pre-cast continuous and horizontal retaining wall three-component system according to claim 10, wherein said one or more continuous and horizontal pre-cast concrete wall is mounted on one continuous and horizontal poured footing and is configured as a non-retaining monument wall and concrete fence.

19. A method for installing a concrete pre-cast continuous and horizontal retaining wall three-component system comprising the steps of:

a) pre-fabricating one or more concrete walls, having reinforcement bars embedded therein, by casting in place horizontally and allowing said one or more pre-cast concrete walls to cure;

b) pouring a continuous and horizontal concrete footing member, having reinforcement bars embedded therein, and allowing said continuous and horizontal concrete footing member to cure;

c) mounting said pre-cast concrete wall onto said continuous and horizontal concrete footing member; and d) connecting said pre-cast concrete wall and said concrete footing member using said reinforcement bar extending between said pre-cast concrete wall and said concrete footing member by pouring a continuous and horizontal concrete buttress support portion;

thereby connecting said pre-cast concrete wall to said continuous and horizontal concrete footing member, by embedding said reinforcement bars, extending between said concrete wall and said concrete footing, within said concrete buttress support portions, when said concrete buttress support portions are poured, to secure the concrete wall and enable retaining wall characteristics throughout the structure of said continuous and horizontal retaining wall system.

* * * * *